US006978637B2

(12) United States Patent
Nishijima et al.

(10) Patent No.: US 6,978,637 B2
(45) Date of Patent: Dec. 27, 2005

(54) EJECTOR CYCLE WITH INSULATION OF EJECTOR

(75) Inventors: Haruyuki Nishijima, Nagoya (JP); Hirotsugu Takeuchi, Nagoya (JP); Makoto Ikegami, Anjo (JP); Hisatsugu Matsunaga, Anjo (JP)

(73) Assignee: Denso Corporation, Kariya (JP)

( * ) Notice: Subject to any disclaimer, the term of this patent is extended or adjusted under 35 U.S.C. 154(b) by 45 days.

(21) Appl. No.: 10/855,900

(22) Filed: May 27, 2004

(65) Prior Publication Data

US 2004/0244408 A1 Dec. 9, 2004

(30) Foreign Application Priority Data

May 28, 2003 (JP) ..... 2003-151393

(51) Int. Cl.[7] ..... F25B 1/06
(52) U.S. Cl. ..... 62/500; 62/512; 417/151
(58) Field of Search ..... 62/500, 512, 525, 62/170, 191, 324.6, 498, 603; 417/151, 195, 417/198

(56) References Cited

U.S. PATENT DOCUMENTS 3,794,137 A * 2/1974 Teodorescu et al. ..... 181/256
4,204,410 A * 5/1980 Kunz ..... 62/500
4,217,175 A * 8/1980 Reilly ..... 202/118
4,487,365 A * 12/1984 Sperber ..... 239/8
4,809,523 A * 3/1989 Vandenberg ..... 62/483
4,944,163 A * 7/1990 Niggemann ..... 62/500
5,324,286 A * 6/1994 Fowle ..... 606/23
6,195,504 B1 * 2/2001 Horie et al. ..... 392/394
6,269,221 B1 * 7/2001 Horie et al. ..... 392/399
6,793,174 B2 * 9/2004 Ouellette et al. ..... 244/23 B
2003/0209031 A1 * 11/2003 Saito et al. ..... 62/500

FOREIGN PATENT DOCUMENTS

JP 4-320762 11/1992
JP 2002-5442 A * 1/2002

* cited by examiner

*Primary Examiner*—Mohammad M. Ali
(74) *Attorney, Agent, or Firm*—Harness, Dickey & Pierce, PLC

(57) ABSTRACT

In an ejector cycle with an ejector including a nozzle for decompressing refrigerant, an insulation member is provided on an outer surface of the ejector to suppress a heat exchange with an external side. When a suction portion of the ejector is insulated by the insulation member, pressure loss in the suction portion can be reduced, a gas refrigerant ratio at an inlet port of the mixing portion can be reduced, and a liquid refrigerant amount to be supplied to the evaporator can be increased. In addition, when a mixing portion and a diffuser portion of the ejector are insulated, it can prevent liquid refrigerant from being excessively evaporated. As a result, it can effectively restrict heat loss due to a heat exchange in the ejector with the external side.

13 Claims, 4 Drawing Sheets

EJECTOR CYCLE WITH INSULATION OF EJECTOR

CROSS REFERENCE TO RELATED APPLICATION

This application is based on Japanese Patent Application No. 2003-151393 filed on May 28, 2003, the disclosure of which is incorporated herein by reference.

BACKGROUND OF THE INVENTION

1. Field of the Invention

The present invention relates to an ejector cycle, more particularly, to an ejector insulation structure for improving cooling capacity and coefficient of performance (COP) in the ejector cycle.

2. Description of the Related Art

FIG. 5 is a schematic diagram showing an ejector cycle in a prior art, and FIG. 6 is a Mollier diagram showing operational states of the ejector cycle in FIG. 5. Refrigerant conditions designated by R1 to R9 in the ejector cycle in FIG. 5 correspond to the operation points on the Mollier diagram in FIG. 6 indicated by the same reference numerals.

In this ejector cycle, high-temperature high-pressure refrigerant discharged from a compressor 1 is cooled and condensed in a condenser 2. High-pressure refrigerant from the condenser 2 is decompressed in a nozzle of an ejector 4 and is mixed with gas refrigerant sucked from an evaporator 3. Refrigerant flowing out of an outlet of the ejector 4 is introduced into a gas-liquid separator 5 to be separated into gas refrigerant and liquid refrigerant. Gas refrigerant from the gas-liquid separator 5 is introduced to the compressor 1 and liquid refrigerant from the gas-liquid separator 5 is introduced to the evaporator 3 to be evaporated in the evaporator 3.

In the ejector cycle, the liquid refrigerant, supplied with a driving flow driven by the compressor 1, evaporates in the evaporator 3 to produce a cooling capacity Q. The amount of energy supplied from the compressor 1 can be indicated by the product of an amount of a driving flow Gn and an enthalpy difference $\Delta i_n$. Here, the enthalpy difference $\Delta i_n$ is a difference between a saturated gas enthalpy at the pressure of the outlet of the evaporator 3, and a refrigerant enthalpy at an outlet of the nozzle.

In contrast, heat loss in the ejector 4 is caused by a heat exchange with an external side. That is, a heat loss $\Delta i_1$ is generated in a mixing portion and a diffuser of the ejector 4, in which kinetic energy of refrigerant is transformed to pressure energy of the refrigerant. When the heat loss $\Delta i_1$ is increased, the refrigerant enthalpy at the inlet portion of the evaporator 3 increases because not only the liquid refrigerant but the gas refrigerant is supplied from the gas-liquid separator 5 to the evaporator 3. In this case, an energy loss $\Delta i_2$ is caused in the evaporator 3.

Consequently, an actual cooling capacity Q is calculated by the following formula (1)

$$Q=Gn\times(\Delta i_n-\Delta i_1-\Delta i_2) \quad (1)$$

In a case where the ejector 4 is provided in a forced convection flow, it is important to suppress the heat losses $\Delta i_1$ and $\Delta i_2$ caused due to the heat exchange in the ejector 4 with the external side.

SUMMARY OF THE INVENTION

In view of the above problems, it is an object of the present invention to provide an ejector cycle having a stable cooling capacity and an improved coefficient of performance (COP) by suppressing heat loss due to a heat exchange with an external side.

According to an aspect of the present invention, an ejector cycle includes a compressor for compressing refrigerant, a high-pressure heat exchanger for radiating heat from high-pressure refrigerant discharged from the compressor, a low-pressure heat exchanger for evaporating low-pressure refrigerant after being decompressed, an ejector and a gas-liquid separator which separates refrigerant flowing from the ejector into gas refrigerant and liquid refrigerant. The ejector includes a nozzle for decompressing and expanding the high-pressure refrigerant from the high-pressure heat exchanger, and a pressure-increasing portion in which gas refrigerant evaporated in the low-pressure heat exchanger is sucked by a high-speed refrigerant flow jetted from the nozzle, and a pressure of refrigerant to be sucked to the compressor is increased by converting expansion energy to pressure energy. In the ejector cycle, an insulation member is provided on an outer surface of the ejector for performing heat insulation. Therefore, it can restrict the refrigerant in the ejector from being heat exchanged with an external side, and heat loss caused due to the heat exchange in the ejector can be reduced. As a result, a stable cooling capacity can be obtained in the ejector cycle, and coefficient of performance (COP) in the ejector cycle can be improved.

Preferably, the ejector further includes a suction portion having a suction port from which gas refrigerant in the low-pressure heat exchanger is sucked, and the suction portion generally has a cylindrical shape and is provided around an outer wall surface of the nozzle to define a first suction refrigerant passage through which refrigerant from the suction port flows toward the pressure increasing portion. In this case, the insulation member is provided at least on an outer surface of the suction portion of the ejector. Because at least the suction portion is heat-insulated from the external side, a density of refrigerant flowing through the suction portion can be increased. Therefore, liquid refrigerant amount supplied to the gas-liquid separator can be increased, and a liquid refrigerant amount to be supplied to the low-pressure side heat exchanger (evaporator) can be increased. Accordingly, the cooling capacity and the COP can be improved in the ejector cycle.

More preferably, the ejector further includes a suction taper portion tapered from the suction portion to the pressure increasing portion, the suction taper portion is provided around the nozzle to define a second suction refrigerant passage through which refrigerant in the first suction refrigerant passage flows to the pressure increasing portion. In this case, the insulation member can be provided at least on an outer surface of the suction portion and the suction taper portion of the ejector.

For example, the pressure increasing portion is constructed with a mixing portion in which the refrigerant jetted from the nozzle and the refrigerant sucked from the low-pressure heat exchanger are mixed, and a diffuser portion downstream from the mixing portion. Further, the diffuser portion has a passage sectional area that increases toward its downstream end side. In this case, the insulation member can be provided at least on an outer surface of the mixing portion. Alternatively, the insulation member can be provided at least on an outer surface of the diffuser portion.

According to another aspect of the present invention, an ejector includes a nozzle for decompressing high-pressure refrigerant from a high-pressure heat exchanger, and an outer wall portion for accommodating the nozzle. Further, the outer wall portion is disposed at an outer side of the nozzle to define a suction portion having a suction port from which gas refrigerant in the low-pressure heat exchanger is sucked, and a pressure-increasing portion in which gas refrigerant evaporated in the low-pressure heat exchanger is sucked by a high-speed refrigerant flow jetted from the nozzle while the gas refrigerant from the suction portion and refrigerant jetted from the nozzle are mixed, and a pressure of refrigerant to be sucked to the compressor is increased by converting expansion energy to pressure energy. In the ejector cycle, at least a part of the outer wall portion is made of an insulation material. Even in this case, a heat exchange of refrigerant in the ejector can be restricted, and pressure loss in the ejector can be reduced. Accordingly, the cooling capacity and COP in the ejector cycle can be effectively improved. For example, all the outer wall portion can be made of the insulation material.

BRIEF DESCRIPTION OF THE DRAWINGS

Additional objects and advantages of the present invention will be more readily apparent from a better understanding of the preferred embodiments described below with reference to the following drawings, in which.

DETAILED DESCRIPTION OF THE PREFERRED EMBODIMENT

A preferred embodiment of the present invention will be described hereinafter with reference to the appended drawings.

Figure 1:
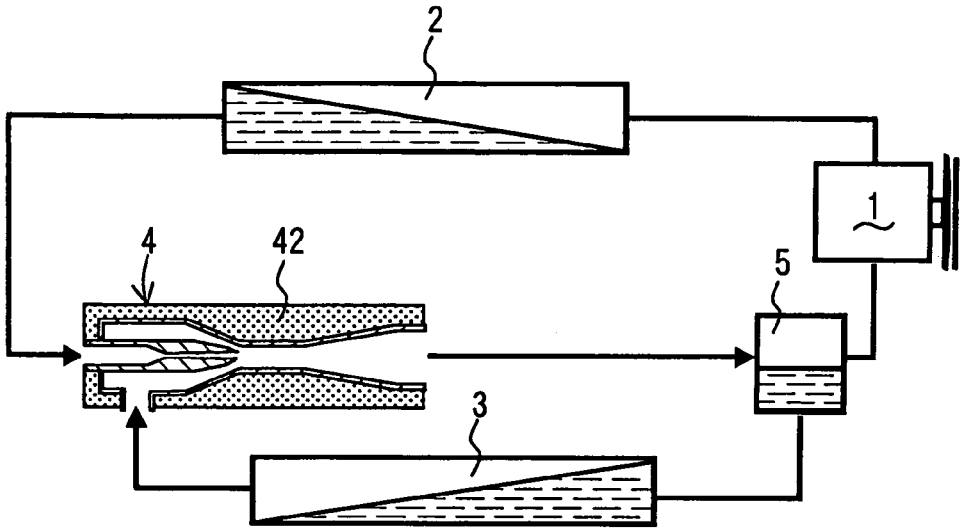
FIG. 1 is a schematic diagram showing an ejector cycle according to a preferred embodiment of the present invention.
Figure 2:
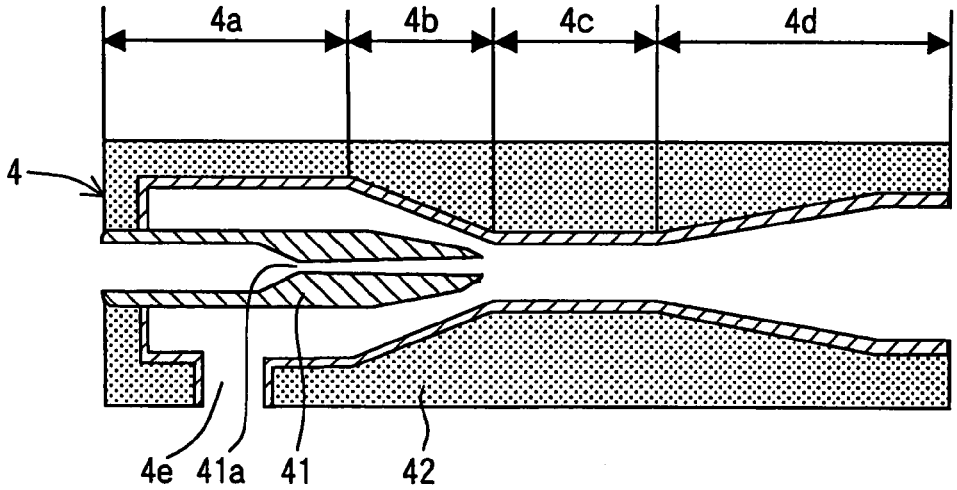
FIG. 2 is a cross-sectional view of an ejector in FIG. 1.

FIG. 1 shows a schematic diagram of an ejector cycle according to the present invention, and FIG. 2 shows a cross-sectional view of an ejector 4 in FIG. 1. In this embodiment, the ejector cycle of the present invention is typically used for a vapor compression refrigerator such as a stationary refrigerator. For example, the stationary refrigerator is used for a showcase for cooling and storing foods, drinks and the like. In this embodiment, carbon dioxide (CO2) is used as refrigerant in the ejector cycle.

A compressor 1 is an electrical compressor driven by electricity for sucking and compressing refrigerant, and a condenser 2 is a high-pressure heat exchanger that exchanges heat between high-pressure and high-temperature refrigerant, discharged from the compressor 1, and outside air for the purpose of cooling the refrigerant. An evaporator 3 is a low-pressure heat exchanger that exchanges heat between air to be blown into the showcase and a low-pressure refrigerant after being decompressed. Liquid refrigerant is evaporated in the evaporator 3 by absorbing heat from the air to be blown into the showcase so that the air to be blown into the showcase is cooled.

The ejector 4 sucks refrigerant vapor evaporated in the evaporator 3 while the refrigerant flowing from condenser 2 is decompressed and expanded. Further, the ejector 4 is provided for increasing a refrigerant pressure to be sucked to the compressor 1 by converting expansion energy of the refrigerant to pressure energy of the refrigerant.

The ejector 4 includes a nozzle 41, and an outer wall portion for accommodating the nozzle 41. The outer wall portion is provided at an outside of the nozzle 41 to define a refrigerant passage with an outer wall surface of the nozzle 41. The outer wall portion of the ejector 4 is formed to construct a suction portion 4*a*, a suction taper portion 4*b*, a mixing portion 4*c*, and a diffuser portion 4*d*. The nozzle 41 decompresses and expands high-pressure refrigerant from the condenser 2 in iso-enthalpy by converting pressure energy to speed energy. The suction portion 4*a* has a suction port 4*e* from which gas refrigerant evaporated in the evaporator 3 is sucked. The suction portion 4*a* and the suction taper portion 4*b* are provided around the nozzle 41 to define a refrigerant suction passage through which gas refrigerant sucked from the suction port 4*e* is introduced to the mixing portion 4*c*. Refrigerant evaporated in the evaporator 3 is introduced into the mixing portion 4*c* through the suction portion 4*a* and the suction taper portion 4*b* by using an entrainment function of high-speed refrigerant stream jetted from the nozzle 41, and is mixed with the refrigerant jetted from the nozzle 41 in the mixing portion 4*c*. The diffuser portion 4*d* further mixes the refrigerant injected from the nozzle 4 and the refrigerant sucked from the evaporator 3, and increases the refrigerant pressure by converting speed energy of the mixed refrigerant to pressure energy.

In the mixing portion 4*c*, the driving stream of refrigerant from the nozzle 41 and the suction stream of the refrigerant from the suction port 4*e* are mixed so that their momentum sum is conserved, thereby increasing refrigerant pressure. In the diffuser portion 4*d*, because a refrigerant passage sectional area gradually increases toward its outlet side, the refrigerant speed energy (dynamic pressure) is converted to refrigerant pressure energy (static energy). Thus, in the ejector 4, refrigerant pressure is increased by both of the mixing portion 4*c* and the diffuser portion 4*d*. Accordingly, in the ejector 4, a pressure increasing portion for increasing the refrigerant pressure to be introduced to the compressor 1 is constructed with the mixing portion 4*c* and the diffuser portion 4*d*.

In this embodiment, "Laval nozzle" (refer to Fluid Engineering published by Tokyo University Press) is adopted as the nozzle 41 to accelerate refrigerant jetted from the nozzle 41 equal to or higher than the sound velocity. The Laval nozzle 41 includes a throttle 41*a* having a smallest passage area in its refrigerant passage. However, a nozzle tapered toward its outlet can also be used as the nozzle 41.

Furthermore, as a main feature of this invention, the outer surface of the ejector 4 is provided with an insulating member 42 made of an insulating material such as expanded polystyrene or urethane form, for performing heat insulation in the ejector 4. The insulating member 42 can be formed by bonding the insulating material to the ejector 4. Alternatively, the insulating member 42 can be formed by molding the insulating material around the periphery of the ejector 4 after the ejector 4 is inserted in a mold die at a predetermined position.

In FIG. 1, refrigerant is discharged from the ejector 4, and flows into a gas-liquid separator 5. The gas-liquid separator 5 separates the refrigerant from the ejector 4 into gas refrigerant and liquid refrigerant, and stores the separated liquid refrigerant therein. The gas-liquid separator 5 includes a gas refrigerant outlet connected to a suction port of the compressor 1, and a liquid refrigerant outlet connected to a refrigerant inlet of the evaporator 3.

Next, the operation of the ejector cycle according to this embodiment is described. The high-temperature high-pressure gas refrigerant compressed in the compressor 1 is condensed and liquefied in the condenser 2 by exchanging heat with, for example, outside air. The condensed and liquefied high-pressure liquid refrigerant is decompressed and expanded in the nozzle 41 of the ejector 4 to a gas-liquid two-phase state. The refrigerant in gas-liquid two-phase state is jetted from the nozzle 41 to be mixed in the mixing portion 4*c* with the gas refrigerant sucked from the suction port 4*e*. Then, the pressure of the mixed refrigerant is increased while passing through the diffuser portion 4*d*.

The refrigerant in gas-liquid two-phase state jetted from the ejector 4 is separated into gas refrigerant and liquid refrigerant in the gas-liquid separator 5. The separated liquid refrigerant is supplied to the evaporator 3 to be evaporated by exchanging heat with, for example, ventilation air, resulting to be a gas refrigerant. This gas refrigerant evaporated in the evaporator 3 is sucked to the ejector 4. Then, the gas refrigerant separated in the gas-liquid separator 5 is sucked to the compressor 1 and is compressed in the compressor 1.

Figure 3A:
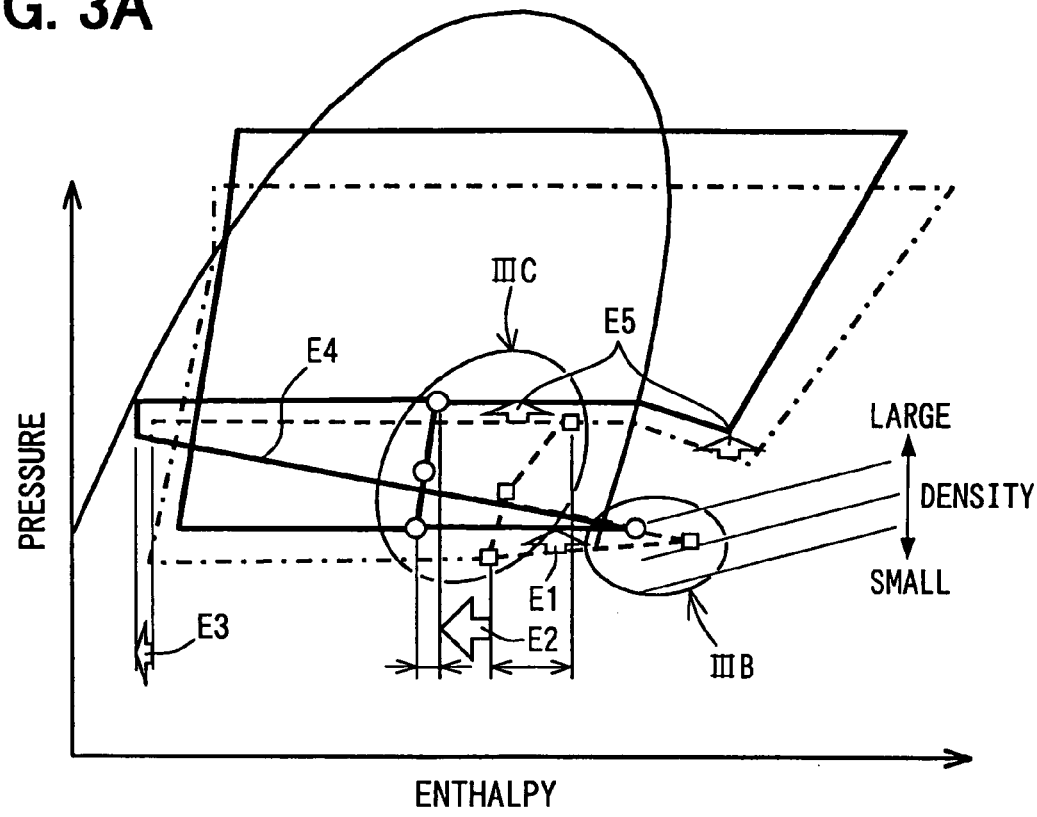
FIG. 3A is a Mollier diagram in the ejector cycle of FIG. 1.
Figure 3B:
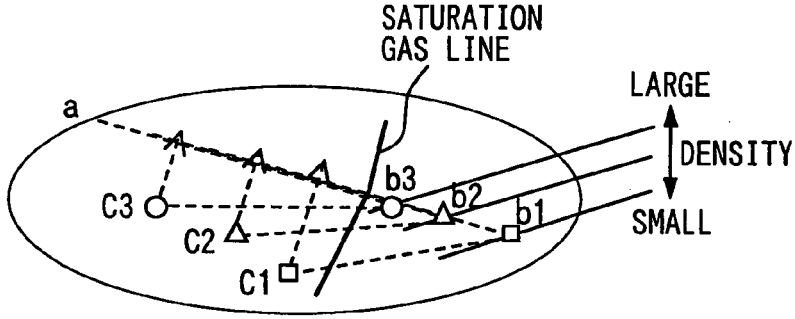
FIG. 3B is a detailed view of the portion IIIB in FIG. 3A.
Figure 3C:
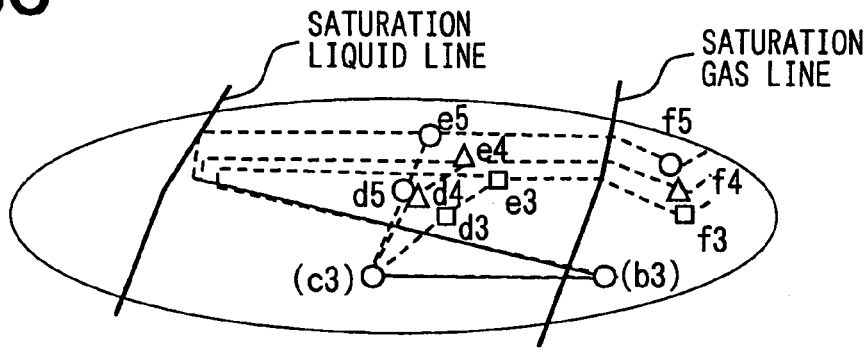
FIG. 3C is a detailed view of the portion IIIC in FIG. 3A.

In this embodiment of the present invention, heat insulation is performed by attaching the insulating member 42 on the outer surface of the ejector 4. The operational effect of the heat insulation of the insulation member 42 is explained by using FIGS. 3A, 3B and 3C. FIG. 3A is the Mollier diagram of the present embodiment (FIG. 1), FIG. 3B is the detailed view of the portion IIIB in the Mollier diagram, and FIG. 3C is the detailed view of the portion IIIC in the Mollier diagram. The effect of insulation member 42 in the ejector cycle 4 is explained in each portion of the ejector 4.

(1) First, the insulation of the suction portion 4*a* will be now described. In this embodiment, because the suction portion 4*a* is insulated by the insulation member 42, it can prevent refrigerant in the suction portion 4*a* from being heated. Therefore, the density of the refrigerant flowing into the mixing portion 4*c* increases. As a result, it is possible to increase an amount of liquid refrigerant at the inlet of the mixing portion 4*c*, an amount of liquid refrigerant supplied to the gas-liquid separator 5, and an amount of liquid refrigerant to be supplied to the evaporator 3. This insulation effect is shown in the Mollier diagram in FIG. 3B by the path (a→b2→c2) against the path (a →b1 →c1) in a comparison example where the insulation material is not provided in the suction portion 4*a*.

(2) The insulation of the suction taper portion 4*b* will be now described. Refrigerant flowing in the suction taper portion 4*b* has a high flow velocity due to its throttled shape of the refrigerant passage outside the nozzle 41. Therefore, a heat transmission coefficient of an inner surface of the suction taper portion 4*b* is increased, and the refrigerant in the suction taper portion 4*b* is readily heat-exchanged with outside. In this embodiment, because the insulation of the suction taper portion 4*b* is performed, the density of gas refrigerant flowing into the mixing portion 4*c* can be increased. Thus, it is possible to effectively increase the amount of liquid refrigerant at the inlet of the mixing portion 4*c*, the amount of the liquid refrigerant supplied to the gas-liquid separator 5, and the amount of the liquid refrigerant to be supplied to the evaporator 3. When the insulation member is provided on both the suction portion 4*a* and the suction taper portion 4*b*, the insulation effect of is shown in the Mollier diagram in FIG. 3B by the path (a →b3→c3).

(3) Next, the insulation of the mixing portion 4*c* will be now described. In the mixing portion 4*c*, fine liquid droplets injected from the nozzle 41 and gas refrigerant sucked from the suction taper portion 4*b* are mixed. Therefore, a flow speed of the liquid droplets is decreased, and the pressure thereof is increased. Thus, when the mixing portion 4*c* is insulated, the liquid evaporation in the mixing portion 4*c* can be restricted, and the density of refrigerant flowing into the mixing portion 4*c* can be increased. Accordingly, it is possible to increase the amount of the liquid refrigerant at the inlet of the mixing portion 4*c*, the amount of liquid refrigerant flowing into the gas-liquid separator 5 and the amount of liquid refrigerant to be supplied to the evaporator 3. Further, in this case, the pressure increase amount of refrigerant to be sucked to the compressor 1 can be effectively increased in the mixing portion 4*c*. The insulation effect is shown in the Mollier diagram in FIG. 3C. When the insulation member 42 is provided on both the suction portion 4*a* and the suction taper portion 4*b*, the insulation effect is shown in the Mollier diagram by the path (d3→e3→f3) in FIG. 3C. In contrast, when the insulation member 42 is provided on the suction portion 4*a*, the suction taper portion 4*b* and the mixing portion 4*c*, the insulation effect is shown in the Mollier diagram by the path (d4→e4→f4) in FIG. 3C.

(4) Next, the insulation of the diffuser portion 4*d* will be now described. The passage sectional area of the diffuser portion 4*d* is expanded toward its downstream end side, compared to the mixing portion 4*c*. Therefore, the flow speed of refrigerant is further decreased in the diffuser portion 4*d*, and the pressure of the refrigerant is further increased. Because the diffuser portion 4*d* is insulated, it can restrict the liquid evaporation from being caused in the diffuser portion 4*d*. Therefore, it is possible to increase the amount of the liquid refrigerant supplied to the gas-liquid separator 5 and the amount of liquid refrigerant to be supplied to the evaporator 3. In this case, the pressure increase amount of refrigerant in the diffuser portion 4*d* can be increased, and the pressure of refrigerant to be sucked to the compressor 1 can be effectively increased. When the insulation member 42 is provided on all the suction portion 4*a*, the suction taper portion 4*b*, the mixing portion 4*c* and the diffuser portion 4*d*, the insulation effect is shown in the Mollier diagram in FIG. 3C by the path (d5→e5→f5).

In this embodiment, because the outer surface of the ejector 4 is insulated by the insulation member 42, the following effects (advantages) can be obtained. Specifically, the pressure loss in the suction portion (i.e., suction portion 4*a*, suction taper portion 4*b*) can be effectively reduced as shown by arrow E1 in FIG. 3A, and the energy loss in the pressure increasing portion (i.e., mixing portion 4*c*, diffuser portion 4*d*) can be reduced as shown by arrow E2 in FIG. 3A. In addition, the enthalpy of refrigerant at the refrigerant inlet of the evaporator 3 can be enlarged as shown by the arrow E3 in FIG. 3A, the suction flow amount of refrigerant can be increased as shown by E4 in FIG. 3A, and the refrigerant pressure to be sucked to the compressor 1 can be increased due to the refrigerant pressure increase as shown by the arrows E5 in FIG. 3A.

Figure 4:
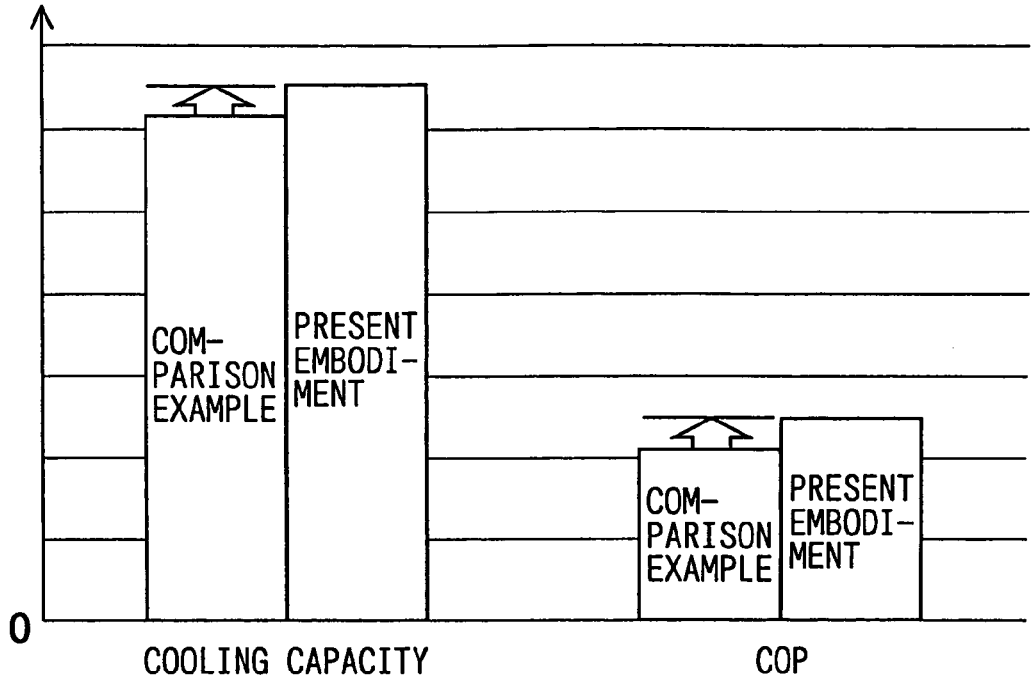
FIG. 4 is a graph chart showing advantages of cooling capacity and COP (Coefficient Of Performance) in the present embodiment, compared to a comparison example.
Figure 5:
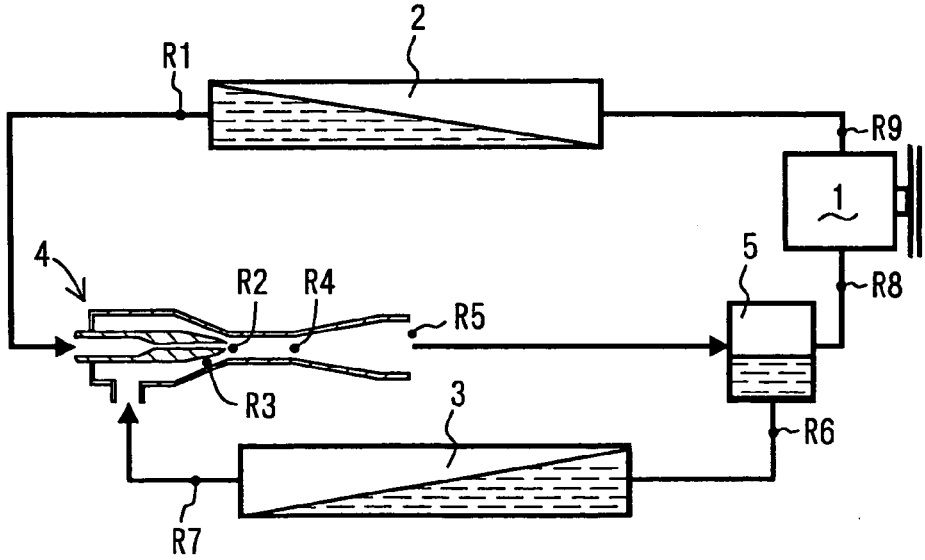
FIG. 5 PRIOR ART
FIG. 5 is a schematic diagram showing an ejector cycle in a prior art.
Figure 6:
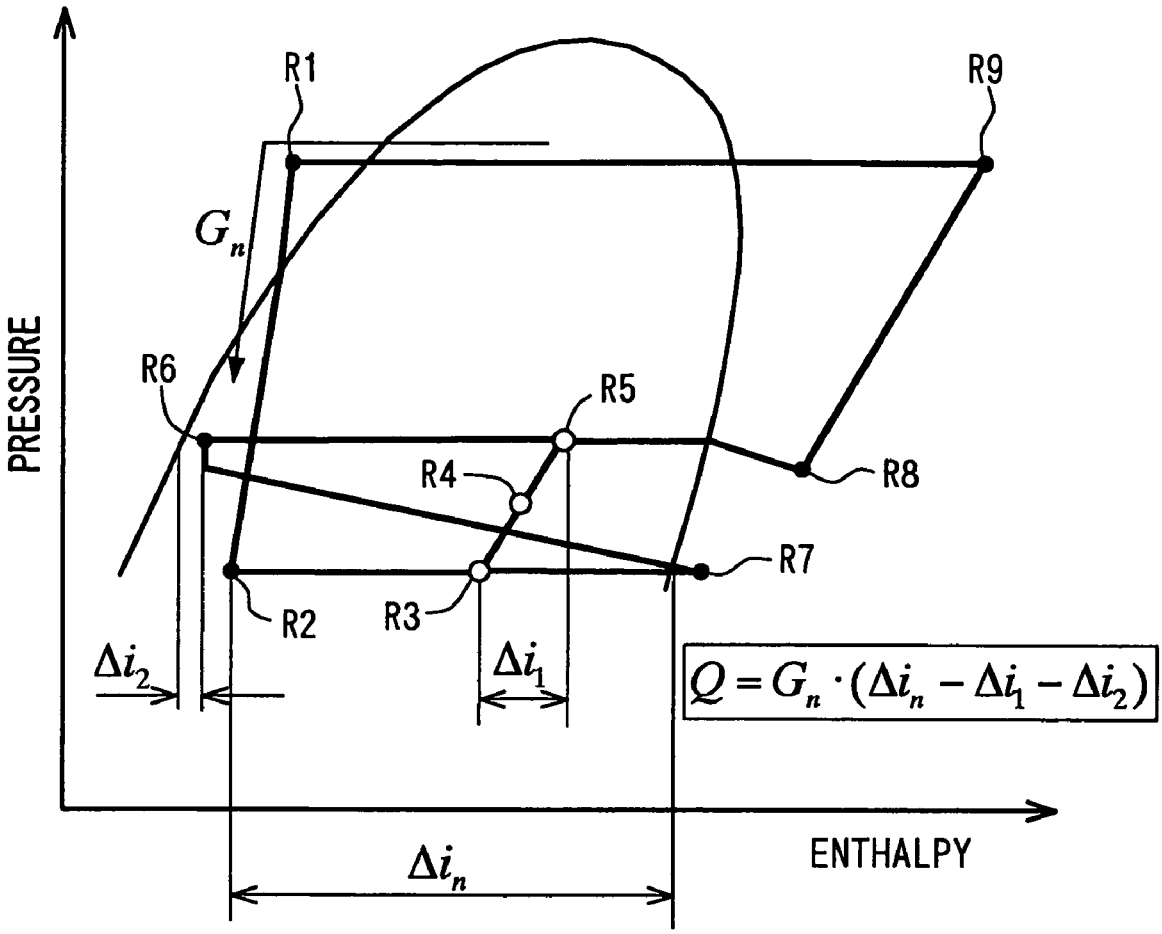
FIG. 6 PRIOR ART
FIG. 6 is a Mollier diagram in the ejector cycle of FIG. 5, for explaining problems in the prior art.

The advantages of the cooling capacity and the COP according to the present invention are shown in the graph of FIG. 4, as compared with a comparison example where the insulation member 42 is not provided on the outer surface of the ejector 4. In the experiments in FIG. 4, the ejector cycle is used for a refrigerator mounted on a vehicle, the outside air temperature is 35° C., an inner temperature of the showcase of the refrigerator is −18° C., and chlorofluorocarbon (Freon) is used as the refrigerant in the ejector cycle. According to the present invention, the cooling capacity is increased by 6% and the coefficient of performance (COP) is increased by 16%, as compared with the comparison example. Further, the ejector cycle of the present invention can be suitably used for a stationary refrigerator that uses carbon dioxide as the refrigerant. Even in this case, the cooling capacity and coefficient of performance (COP) of the stationary refrigerator can be improved steadily, as compared with the comparison example.

OTHER EMBODIMENTS

Although the present invention has been fully described in connection with the preferred embodiment thereof with reference to the accompanying drawings, it is to be noted that various changes and modifications will become apparent to those skilled in the art.

For example, in the above-described embodiment, the insulation member 42 made of a thermal insulation material is provided on the outer surface of the ejector 4. However, the outer wall portion of the ejector 4, for forming the suction refrigerant passage and the pressure increasing portion, can be formed from a thermal insulation material with insulation function. In this case, it is unnecessary to provide the insulation member 42 on the outer surface of the ejector 4. In addition, at least a part of the outer surface of the ejector 4 can be covered with the insulation member 42 or at least a part of the outer wall portion of the ejector 4 can be formed of an insulation material. Also, instead of using carbon dioxide or the Freon as the refrigerant, the other refrigerants such as hydrocarbon can be used as the refrigerant.

Although the ejector cycle of the present invention is used for the vapor compression refrigerator for showcase, the ejector cycle can also be used, for example, for an air conditioner or a refrigerator mounted on a vehicle. Further, the ejector 4 has the nozzle 41 with a fixed throttle; however, it is possible for the ejector 4 to have a nozzle with a variable throttle. In this case, the throttle opening degree of the variable throttle of the nozzle 41 can be changed electrically or mechanically in accordance with a super-heating degree of refrigerant at the refrigerant outlet side of the evaporator 3. Further, the refrigerant pressure on the high-pressure side before being decompressed may be above or below the critical pressure of the refrigerant. When the pressure of the high-pressure refrigerant is higher than the critical pressure, gas refrigerant is not condensed in the condenser 2 while being cooled in the condenser 2.

Such changes and modifications are to be understood as being within the scope of the present invention as defined by the appended claims.

What is claimed is:

1. An ejector cycle comprising:

a compressor for compressing refrigerant;

a high-pressure heat exchanger for radiating heat from high-pressure refrigerant discharged from the compressor;

a low-pressure heat exchanger for evaporating low-pressure refrigerant after being decompressed;

an ejector including a nozzle for decompressing and expanding the high-pressure refrigerant from the high-pressure heat exchanger, and a pressure-increasing portion in which gas refrigerant evaporated in the low-pressure heat exchanger is sucked by a high-speed refrigerant flow jetted from the nozzle, and a pressure of refrigerant to be sucked to the compressor is increased by converting expansion energy to pressure energy;

a gas-liquid separator which separates refrigerant flowing from the ejector into gas refrigerant and liquid refrigerant, the gas-liquid separator having a gas refrigerant outlet connected to a refrigerant suction side of the compressor, and a liquid refrigerant outlet connected to a refrigerant inlet side of the low-pressure heat exchanger; and an insulation member, provided on an outer surface of the ejector, for performing heat insulation.

2. The ejector cycle according to claim 1, wherein:

the ejector further includes a suction portion having a suction port from which gas refrigerant in the low-pressure heat exchanger is sucked;

the suction portion generally has a cylindrical shape and is provided around an outer wall surface of the nozzle to define a first suction refrigerant passage through which refrigerant from the suction port flows toward the pressure increasing portion; and the insulation member is provided at least on an outer surface of the suction portion of the ejector.

3. The ejector cycle according to claim 2, wherein:

the ejector further includes a suction taper portion tapered from the suction portion to the pressure increasing portion;

the suction taper portion is provided around the nozzle to define a second suction refrigerant passage through which refrigerant in the first suction refrigerant passage flows to the pressure increasing portion; and the insulation member is provided at least on an outer surface of the suction portion and the suction taper portion of the ejector.

4. The ejector cycle according to claim 1, wherein:

the pressure increasing portion is constructed with a mixing portion in which the refrigerant jetted from the nozzle and the refrigerant sucked from the low-pressure heat exchanger are mixed, and a diffuser portion downstream from the mixing portion;

the diffuser portion has a passage sectional area that is increased toward its downstream end side; and the insulation member is provided at least on an outer surface of the mixing portion.

5. The ejector cycle according to claim 1, wherein:

the pressure increasing portion is constructed with a mixing portion in which the refrigerant jetted from the nozzle and the refrigerant sucked from the low-pressure heat exchanger are mixed, and a diffuser portion downstream from the mixing portion;

the diffuser portion has a passage sectional area that is increased toward its downstream end side; and the insulation member is provided at least on an outer surface of the diffuser portion.

6. The ejector cycle according to claim 1, wherein carbon dioxide is used as the refrigerant.

7. The ejector cycle according to claim 1, wherein Freon is used as the refrigerant.

8. The ejector cycle according to claim 1, wherein carbon hydride is used as the refrigerant.

9. The ejector cycle according to claim 1, wherein the ejector cycle is a stationary refrigerator.

10. The ejector cycle according to claim 1, wherein the ejector cycle is a refrigerator mounted on a vehicle.

11. An ejector cycle comprising:

a compressor for compressing refrigerant;

a high-pressure heat exchanger for radiating heat from high-pressure refrigerant discharged from the compressor;

a low-pressure heat exchanger for evaporating low-pressure refrigerant after being decompressed;

an ejector including a nozzle for decompressing and expanding the high-pressure refrigerant from the high-pressure heat exchanger; and a gas-liquid separator which separates refrigerant flowing from the ejector into gas refrigerant and liquid refrigerant, the gas-liquid separator having a gas refrigerant outlet connected to a refrigerant suction side of the compressor, and a liquid refrigerant outlet connected to a refrigerant inlet side of the low-pressure heat exchanger, wherein:

the ejector further includes an outer wall portion for accommodating the nozzle; and the outer wall portion is disposed at an outer side of the nozzle to define a suction portion having a suction port from which gas refrigerant in the low-pressure heat exchanger is sucked, and a pressure-increasing portion in which gas refrigerant evaporated in the low-pressure heat exchanger is sucked by a high-speed refrigerant flow jetted from the nozzle while the gas refrigerant from the suction portion and refrigerant jetted from the nozzle are mixed, and a pressure of refrigerant to be sucked to the compressor is increased by converting expansion energy to pressure energy; and at least a part of the outer wall portion is made of an insulation material.

12. The ejector cycle according to claim 11, wherein:

the outer wall portion includes an inner wall for directly defining the suction portion and the pressure increasing portion, and an insulation member bonded to an outer surface of the inner wall; and the inner wall is made of metal, and the insulation member is made of an insulation material.

13. The ejector cycle according to claim 11, wherein all the outer wall portion is made of the insulation material.

* * * * *